US006948848B2

(12) United States Patent
Ausnit

(10) Patent No.: US 6,948,848 B2
(45) Date of Patent: Sep. 27, 2005

(54) RECLOSABLE PACKAGING HAVING SLIDER-OPERATED STRING ZIPPER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 120 days.

(21) Appl. No.: 10/401,365

(22) Filed: Mar. 27, 2003

(65) Prior Publication Data

US 2004/0190798 A1 Sep. 30, 2004

(51) Int. Cl.[7] ..... B65D 33/16
(52) U.S. Cl. ..... 383/64; 24/399
(58) Field of Search ..... 383/64; 24/399–400

(56) References Cited

U.S. PATENT DOCUMENTS 3,426,396 A 2/1969 Laguerre
4,262,395 A * 4/1981 Kosky ..... 24/400
5,983,466 A 11/1999 Petkovsek
6,088,887 A 7/2000 Bois
6,247,844 B1 * 6/2001 Tomic et al. ..... 383/64
6,264,366 B1 7/2001 Custer
6,286,999 B1 9/2001 Cappel et al.
6,461,042 B1 * 10/2002 Tomic et al. ..... 383/64
6,477,821 B1 11/2002 Bois
6,698,926 B2 * 3/2004 Buchman ..... 383/64

* cited by examiner

*Primary Examiner*—Jes F. Pascua
(74) *Attorney, Agent, or Firm*—Ostrager Chong Flaherty & Broitman PC

(57) ABSTRACT

A reclosable package has a slider-operated string zipper joined to the receptacle mouth. The slider includes a plow that pries apart the zipper sections lying in its path during slider travel in an opening direction; first and second sidewalls disposed on opposite sides of the plow and bounding a slider tunnel, and first and second ledges supported by the plow. The first zipper part passes through a first space between the first sidewall and the plow, while the second zipper part passes through a second space between the second sidewall and the plow. The first ledge is the only portion of the slider that underlies any portion of the first zipper part, while the second ledge is the only portion of the slider that underlies any portion of the second zipper part. Accordingly, the ledges retain the zipper parts with the spaces on the opposing sides of the plow.

22 Claims, 4 Drawing Sheets

RECLOSABLE PACKAGING HAVING SLIDER-OPERATED STRING ZIPPER

BACKGROUND OF THE INVENTION

This invention generally relates to zippers for use in reclosable packaging, such as bags or pouches. In particular, the invention relates to string zippers for reclosable bags.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag-making film, for example, by conduction heat sealing. These separate closure strips typically have flanges extending therefrom in such a way that the flanges can be joined to bag-making film in order to attach the closure strips to the film. Previous slider-operated, separately extruded zippers used flange-type constructions.

An alternative zipper design is the so-called flangeless or string zipper, which has no flange portion above or below the interlockable closure profiles. In the case of a string zipper, the bag-making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

There is a continuing need for new designs for reclosable bags that can be manufactured at low cost.

BRIEF DESCRIPTION OF THE INVENTION

The present invention is directed to improvements in a type of reclosable package comprising a receptacle having an interior volume, and a slider-operated string zipper attached to the receptacle for allowing access to the interior volume.

One aspect of the invention is a reclosable package comprising a receptacle having a mouth, a string zipper joined to the receptacle at the mouth, the string zipper comprising first and second mutually interlockable zipper parts, and a slider mounted over the string zipper to cause the first and second zipper parts to separate when the slider is moved in one direction along the string zipper and to cause the first and second zipper parts to interlock when the slider is moved in an opposite direction along the string zipper. The slider comprises: a plow that pries apart the sections of the first and second zipper parts lying in its path during slider travel in the one direction; first and second sidewalls disposed on opposite sides of the plow and bounding a slider tunnel, the first zipper part passing through a first space between the first sidewall and the plow, and the second zipper part passing through a second space between the second sidewall and the plow; and a wedge-shaped body disposed at a distal end of the plow. A first projecting portion of the wedge-shaped body forms a first ledge that retains a portion of the first zipper part in the first space, while a second projecting portion of the wedge-shaped body forms a second ledge that retains a portion of the second zipper part in the second space.

Another aspect of the invention is a slider comprising a top wall, first and second sidewalls depending downward from opposing sides of the top wall, a vertical plow depending downward from a central portion of the top wall, the first sidewall being separated from the plow by a first space and the second sidewall being separated from the plow by a second space, and a wedge-shaped body disposed at a distal end of the plow. A first projecting portion of the wedge-shaped body forms a first ledge on one side of the plow, while a second projecting portion of the wedge-shaped body forms a second ledge on the other side of the plow.

A further aspect of the invention is a reclosable package comprising a receptacle having a mouth, a string zipper joined to the receptacle at the mouth, and a slider mounted over the string zipper to cause first and second mutually interlockable zipper parts to separate when the slider is moved in one direction along the string zipper and to cause the first and second zipper parts to interlock when the slider is moved in an opposite direction along the string zipper, wherein the slider comprises: a plow that pries apart the sections of the first and second zipper parts lying in its path during slider travel in the one direction; first and second sidewalls disposed on opposite sides of the plow and bounding a slider tunnel, the first zipper part passing through a first space between the first sidewall and the plow, and the second zipper part passing through a second space between the second sidewall and the plow; a first projection projecting laterally from a distal end of the plow toward the first sidewall; and a second projection projecting laterally from the distal end of the plow toward the second sidewall. The first projection retains a portion of the first zipper part in the first space, the second projection retains a portion of the second zipper part in the second space, and there are no projections projecting from either of the first or second sidewalls that underlie any portion of either of the first or second zipper parts.

Yet another aspect of the invention is a reclosable package comprising a receptacle having a mouth, a string zipper joined to the receptacle at the mouth, and a slider mounted over the string zipper to cause first and second mutually interlockable zipper parts to separate when the slider is moved in one direction along the string zipper and to cause the first and second zipper parts to interlock when the slider is moved in an opposite direction along the string zipper, wherein the slider comprises: a plow that pries apart the sections of the first and second zipper parts lying in its path during slider travel in the one direction; first and second sidewalls disposed on opposite sides of the plow and bounding a slider tunnel, the first zipper part passing through a first space between the first sidewall and the plow, and the second zipper part passing through a second space between the second sidewall and the plow; and first and second ledges supported by the plow, the first ledge being the only portion of the slider that underlies any portion of the first zipper part, and the second ledge being the only portion of the slider that underlies any portion of the second zipper part.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
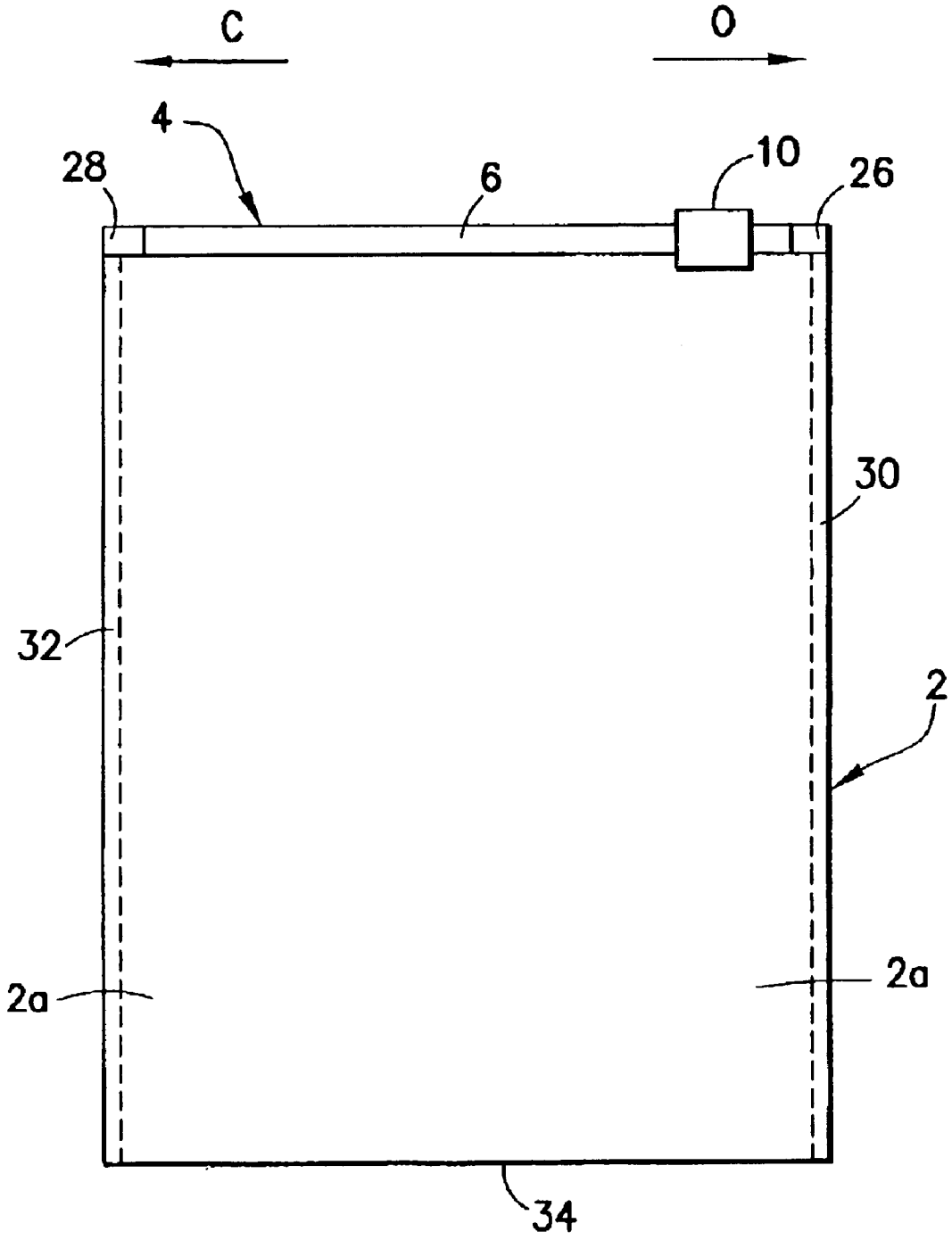
FIG. 1 is a drawing showing a reclosable package having a slider-operated string zipper with end stops.

A reclosable package comprising a bag or receptacle 2 and a flexible plastic string zipper 4 operated by manipulation of a slider 10 is shown in FIG. 1. It should be understood that the slider-zipper assemblies disclosed herein can be installed in a reclosable package of the type shown in FIG. 1 or other types of reclosable packages having different structures.

The bag 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The bag 2 comprises opposing walls (only the front panel 2*a* is visible in FIG. 1) that may be secured together at opposite side edges of the bag by seams 30 and 32 (indicated by dashed lines). The opposing bottoms of the walls may be joined, for example, by means of a heat seal made in conventional fashion, e.g., by application of heat and pressure. Typically, however, the bottom of the package is formed by a fold 34 in the original packaging film, as depicted in FIG. 1.

At its top end, the bag 2 has an openable mouth, on the inside of which is an extruded plastic string zipper 4. The string zipper 4 comprises a pair of interlockable zipper parts or closure strips. One zipper part 6 is visible in FIG. 1. The profiles of the zipper parts may take any form. For example, the string zipper may comprise interlocking rib and groove elements or alternating hook-shaped closure elements. The preferred zipper material is polyethylene. The upper margins of the front and rear bag walls are respectively sealed to the backs of the respective zipper parts by a conventional conduction heat sealing technique.

The string zipper is operated by sliding the slider 10 along the zipper parts. As the slider moves across the zipper, the zipper is opened or closed. As shown in FIG. 1, the slider is slidable along the zipper in a closing direction "C", causing the zipper parts to become engaged, or in an opening direction "O", causing the zipper parts to become disengaged.

The bag shown in FIG. 1 further comprises end stops 26 and 28 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper.

In accordance with one embodiment of a reclosable package having a slider-operated string zipper (shown in FIG. 2), a pair of interlocking zipper parts 6 and 8 respectively comprise interlocking rib and groove elements, which are well known in the art. The string zipper is preferably an extruded plastic structure comprising a first interlockable profiled zipper part 8 having two generally arrow-shaped rib-like male closure elements or members 30 and 32, and a second interlockable profiled zipper part 6 having two pairs of hook-shaped gripper jaws that form respective complementary female closure elements for receiving the heads of respective male closure elements 30 and 32. More specifically, jaws 34 and 36 receive and interlock with the male element 30, while jaws 38 and 40 receive and interlock with the male element 32. Alternatively, one zipper part could have one male profile and one female profile, while the other zipper part has one female profile and one male profile, or the respective zipper parts could each have more than two male or female profiles.

The profiled zipper part 6 further comprises a sealing bridge 44 that connects the female profiles and to which the upper margin of the bag wall 2*a* is joined, while the profiled zipper part 8 further comprises a base 42 that supports the male profiles and to which the upper margin of the bag wall 2*b* is joined. Preferably, each of the sealing bridge 44 and base 42 is a resiliently flexible self-supporting structure having a thickness greater than the thickness of the bag film. The male and female closure elements are integrally formed with their respective bases. The upper margins of the bag film may have short free ends that extend beyond the termination points depicted in FIG. 2 so long as the free ends are not so long as to interfere with travel of the slider along the zipper or become entangled with the zipper profiles.

The groove of each female profile receives the head of a respective male member when the zipper is closed. Closing of the zipper is accomplished as follows. When the male members 30 and 32 are properly aligned with and then moved into engagement with the opposing female profiles, the head of each male member will penetrate the opening in the opposing female profile. As the head of each male member penetrates the female profile, the resilient hooks of the opposing gripper jaws are cammed apart by the inclined surfaces running from the tip to the shoulders of each male member. The camming force exerted on the hooks of each female member by the head of the penetrating male member is transferred to the resilient walls of the gripper jaws, causing those walls to flex outwardly. The walls are flexed outward, in opposite directions, until the hooks of the female member pass by and snap into interlocking relation behind the shoulders of the male member. The heads of the male members 30 and 32 are received in the grooves of the respective female profiles and held there by the interlocked hooks, this situation constituting the closed state of the zipper.

To open the closed zipper, the zipper parts 6 and 8 are pried apart with sufficient force to pull the heads of the male members out of the female profiles. When the shoulders of the male members clear the hooks of the outwardly flexed gripper jaws, the male and female members are no longer interlocked and the zipper is open.

Figure 2:
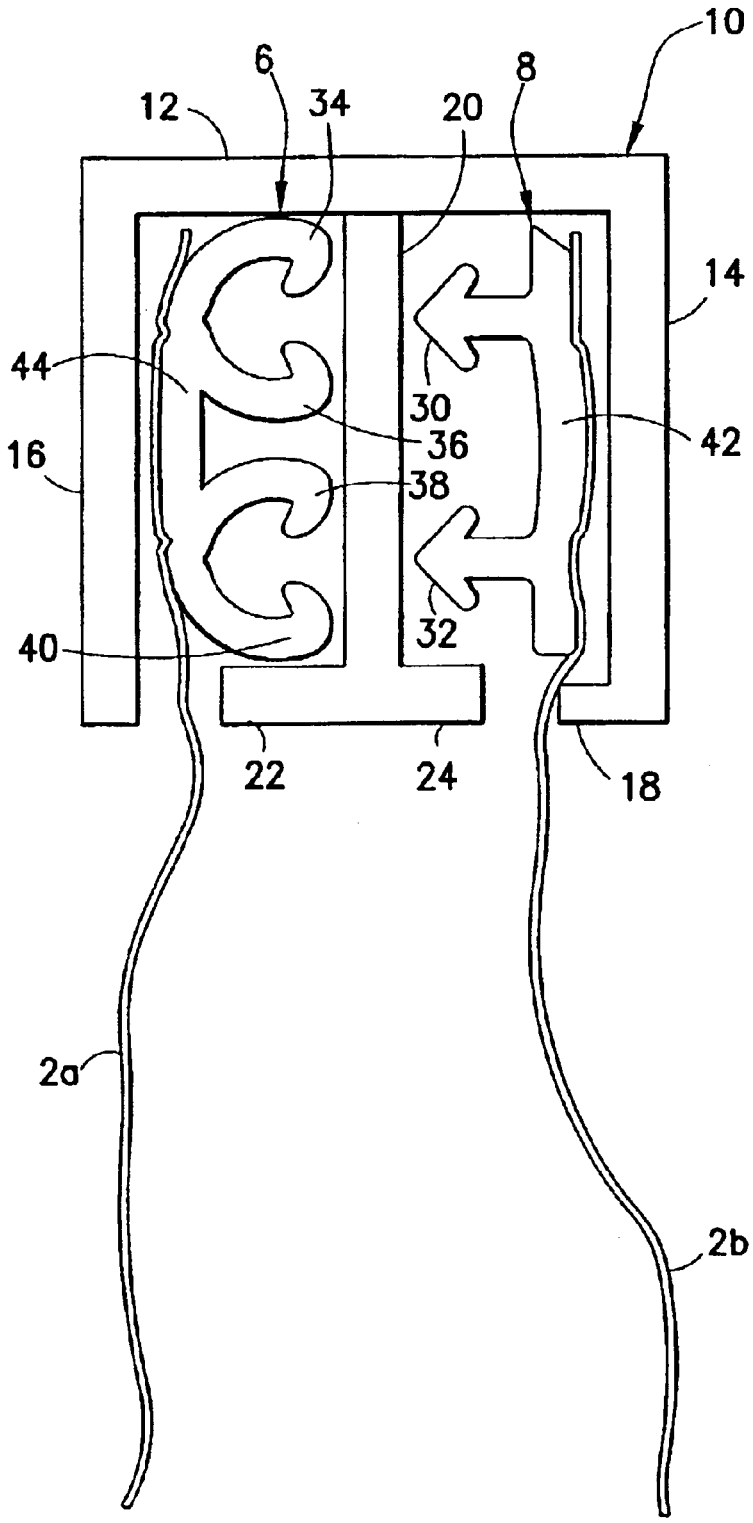
FIG. 2 is a drawing showing a partially sectioned view of a slider-string zipper assembly in accordance with one embodiment disclosed in U.S. patent application Ser. No. 10/367,450.

As seen in FIG. 2, the slider 10 for opening or closing the reclosable zipper is generally shaped so that the slider straddles the zipper profiles. The upper margins of the bag walls 2*a* and 2*b*, which are joined to the back sides of the zipper parts 6 and 8, are disposed between the respective zipper parts and the respective side walls 16 and 14 of the slider. A sealant layer (not shown) may be co-extruded onto the backs of the zipper parts to facilitate sealing of the bag-making film to the zipper parts.

The slider 10 comprises a top wall 12, a pair of side walls 14 and 16 connected to opposing sides of the top wall 12, the top wall 12 and side walls 14, 16 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by a pair of substantially planar, inclined interior surfaces (not shown in FIG. 2), which converge toward the closing window of the slider. These inclined surfaces cam or squeeze the zipper parts toward each other, causing the zipper profiles to interlock, as the slider is moved in the closing direction along the zipper.

The slider further comprises a plow 20 depending from a central portion of the top wall and dividing the slider tunnel into two channels, one for each zipper part. In accordance with this embodiment, retaining projections 22 and 24 extend in opposite directions from the distal end of the plow 20. The projection 22 is longer than the projection 24 and is designed to retain the zipper part 6 having two female profiles without the assistance of an opposing retaining projection on the sidewall 16. The shorter projection 24, on the other hand, is designed to retain the zipper part 8 having two male profiles with the assistance of an opposing retaining projection 18 projecting from the bottom edge of the sidewall 14.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

In certain instances, where thin bag-making film is used and where pressure exerted on the outside of the slider may cause the tip of the retaining ledge 18 (se FIG. 2) to cut into the film, it may be desirable to use a construction different than that shown in FIG. 2 to hold the slider on the zipper. In such a construction the retaining ledges project only from the plow and not from the slider side wall.

Figure 3:
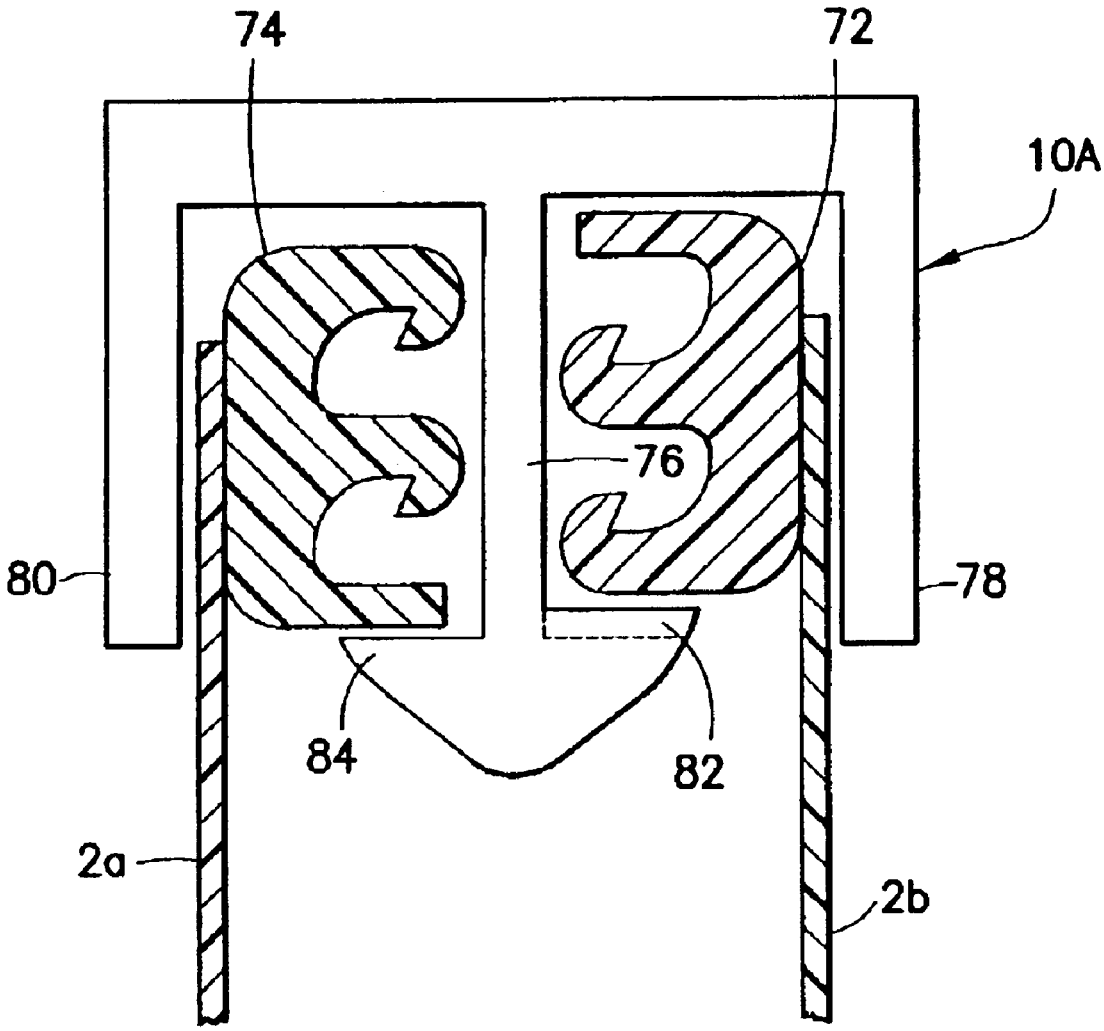
FIG. 3 is a drawing showing a partially sectioned view of a slider-string zipper assembly in accordance with one embodiment of the present invention.

The mouth portion of a reclosable package in accordance with one such embodiment is depicted in FIG. 3. The string zipper comprises a pair of zipper parts or closure strips 72 and 74, each zipper part comprising a pair of hooks that interlock with each other when squeezed together when the slider 10A moves in one direction and that are separated by a plow 76 when the slider moves in the opposite direction. Instead of retaining ledges on the side walls 78 and 80 of the slider, a pair of retaining ledges 82 and 84 project in opposite directions from the distal end of the plow 76. Again the upper margins of the bag walls 2*a* and 2*b* are sealed to the backs of the string zipper parts, in this case zipper parts 74 and 72, respectively. The retaining ledges 82 and 84 are parts of a wedge-shaped body formed at the distal end of the plow. The wedge shape facilitates insertion of the slider onto the zipper. Since due to its construction, the bottom of closure strip 72 is positioned above the bottom of closure strip 74, the corresponding retaining ledge 82 may have added material (indicated by dotted lines) to provide greater resistance to the slider being pulled out of the zipper.

Figure 4:
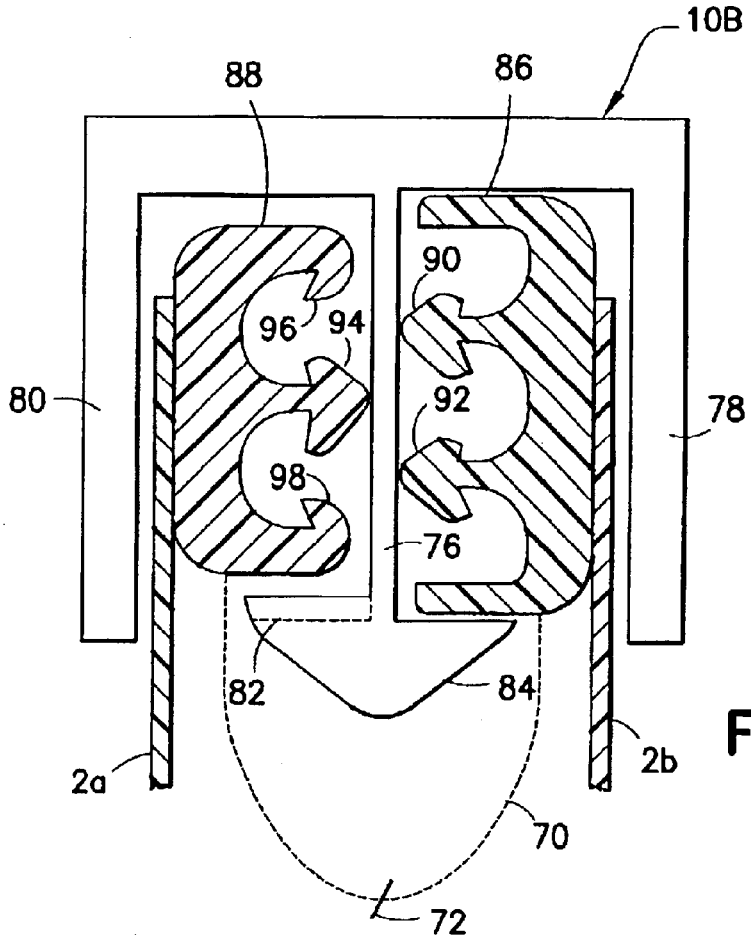
FIG. 4 is a drawing showing a partially sectioned view of a slider-string zipper assembly in accordance with another embodiment of the invention.

Yet another embodiment of the invention is depicted in FIG. 4. The string zipper comprises a pair of zipper parts or closure strips 86 and 88 having complementary profiles. The upper margins of the bag walls 2*a* and 2*b* are sealed to the backs of the string zipper parts 88 and 86, respectively. Zipper part 86 has a pair of male members 90 and 92, while the zipper part 88 has a single male member 94 flanked by a pair of hooks 96 and 98. The head of male member 90 is received in the female profile formed by hook 96 and one tooth of the head of male member 94, while the head of male member 92 is received in the female profile formed by hook 98 and the other tooth of the head of male member 94. The lower tooth of each male member head may be larger than the corresponding upper tooth. The differentially sized teeth provide an opening force differential between the inside and outside of the bag, i.e., they provide greater resistance to opening of the bag from the inside.

The zipper parts 86 and 88 interlock with each other when squeezed together by the slider 10B moving in one direction and are separated by a plow 76 by the slider moving in the opposite direction. Again a pair of retaining ledges 82 and 84 project in opposite directions from the distal end of the plow 76, these retaining ledges being parts of a wedge-shaped body formed at the distal end of the plow. Again one of the retaining ledges (e.g., 82) may have added material (indicated by dotted lines) to provide greater resistance to the slider being pulled out of the zipper.

A hermetic seal may optionally be provided by spanning the parts 6 and 8 of the string zipper with a frangible membrane or connection 70, indicated by a dashed line in FIG. 4. When the zipper is closed, the frangible connection 70 is folded, with the fold extending into the interior volume of the receptacle, on the so-called "product side" of the zipper. The frangible connection must extend across the full length of the mouth in which the zipper is installed, from one side seal of the receptacle to the other side seal, with the side edges of the folded frangible connection 70 being blended into the respective side seals of the package. As previously described, the side seals (items 30 and 32 in FIG. 1) may be formed by conduction heat sealing. The result is that the edges of the folded connection 70 are captured in and hermetically sealed by the side seals. The hard seals that join the upper marginal portions of the bag walls to the backs of the zipper parts, in conjunction with the side seals that capture the side edges of frangible connection 70, enable the latter to serve as a breakable hermetic seal that prevents the admission of air into the interior volume of the bag. Preferably the connection 70 is thin enough to provide for easy tearing open by the consumer and easy blending into the ultrasonically or heat sealed side seals. In the embodiment depicted in FIG. 4, the connection 70 can be attached to the ends of the zippers 86 and 88 as shown or to the bases of these zippers. Preferably, the connection 70 has a relatively constant thickness, except that a line of weakened tear resistance 72 can be formed in a well-known manner at the cusp of the folded web. For example, the line of weakened tear resistance may consist of a line of reduced thickness formed by laser scoring.

Figure 5:
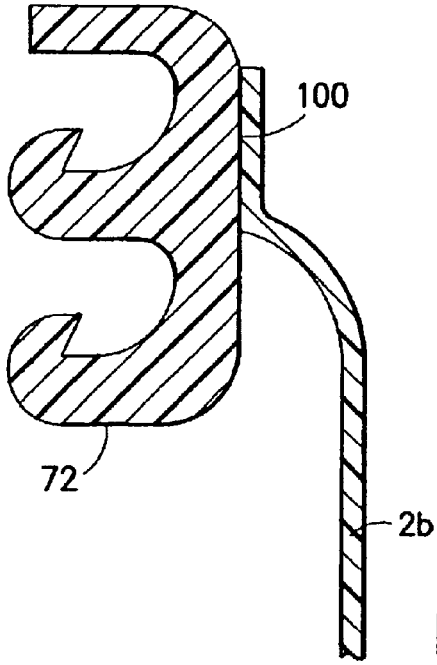
FIG. 5 is a drawing showing hinged joinder of bag making film to the back of a string zipper base strip in accordance with a further aspect of the present invention.

In accordance with a further aspect of the invention, one upper marginal portion of the bag making film is joined, i.e., sealed, to a band-shaped area on the back of one (or both) of the string zipper parts that is displaced from the bottom edge of the base strip, as shown in FIG. 5. More specifically, the band-shaped zone of joinder is located generally above a center point in the elevation of the zipper strip to which it is joined, so that the pulling force exerted by the film does not pull the bottom halves of the zipper profiles apart. In the example presented in FIG. 5, the bag wall 2*b* is joined to the upper half of the back of the zipper strip 72 by a conduction heat seal 100.

In a typical bag having flanged zipper strips, the internal bag forces tend to pull or peel lever away the lower interlocking elements of the zipper from each other by their respective flanges (as would be the case if one were opening the bag from the consumer side by pulling the opening lips apart). By moving the flange point of attachment to the center point or above it, this peeling action is avoided or substantially mitigated. However, when thin films are used, as is the case shown in FIG. 5, the actual point of attachment tends to act as the hinge since the film, due to its thinness, cannot act as a lever on the interlocked zipper profiles.

Instead of the slider having interior walls that converge only after the plow, the slider walls could converge from the opening end to the closing end because the plow could be very short.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. For example, the zipper parts and frangible connection need not be extruded from the same plastic material. More specifically, the connection could be made of a material that is more brittle than the material used to form the zipper parts. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging in which a flexible plastic zipper can be incorporated. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

What is claimed is:

1. A reclosable package comprising a receptacle having a mouth, a string zipper joined to said receptacle at said mouth, said string zipper comprising first and second mutually interlockable zipper parts, and a slider mounted on said string zipper to cause said first and second zipper parts to separate when said slider is moved in one direction along said string zipper and to cause said first and second zipper parts to interlock when said slider is moved in an opposite direction along said string zipper, wherein said slider comprises:

a plow that pries apart the sections of said first and second zipper parts lying in its path during slider travel in said one direction;

first and second sidewalls disposed on opposite sides of said plow and bounding a slider tunnel, said first zipper part passing through a first space between said first sidewall and said plow, and said second zipper part passing through a second space between said second sidewall and said plow; and a wedge-shaped body disposed at a distal end of said plow, a first projecting portion of said wedge-shaped body forming a first ledge that retains a portion of said first zipper part in said first space, and a second projecting portion of said wedge-shaped body forming a second ledge that retains a portion of said second zipper part in said second space, wherein said receptacle comprises first and second marginal film portions respectively joined to respective backs of said first and second zipper parts, said slider traveling along said zipper with said first marginal film portion disposed between said first sidewall of said slider and said first zipper part, and said second marginal film portion disposed between said second sidewall of said slider and said second zipper part.

2. The package as recited in claim 1, wherein said first ledge is disposed at a higher elevation than said second ledge.

3. The package as recited in claim 1, wherein said first projecting portion has more mass than said second projecting portion of said wedge-shaped body.

4. The package as recited in claim 1, wherein said wedge-shaped body has a tip disposed at an elevation lower than the elevation of a bottom edge of said first sidewall.

5. The package as recited in claim 1, wherein said first marginal film portion is joined only to an upper portion of said back of said first zipper part, thereby displacing upward the area where an internal opening force is exerted on the zipper by product inside said receptacle.

6. The package as recited in claim 5, wherein said second marginal film portion is joined only to an upper portion of said back of said second zipper part.

7. The package as recited in claim 1, wherein neither of said first and second sidewalls of said slider has any projection that projects underneath either of said first and second zipper parts.

8. The package as recited in claim 1, wherein said string zipper further comprises a frangible membrane connecting said first and second zipper parts, said frangible membrane extending inside said receptacle on a product side of said zipper and being joined at its ends to said receptacle for forming an airtight seal.

9. The package as recited in claim 1, wherein said first zipper part comprises a first closure member having a male profile in the shape of an asymmetric arrowhead.

10. The package as recited in claim 9, wherein said second zipper part comprises a second closure member having a male profile in the shape of an asymmetric arrowhead, said first and second closure members being mutually engaged when said zipper is closed.

11. A reclosable package comprising a receptacle having a mouth, a string zipper joined to said receptacle at said mouth, said string zipper comprising first and second mutually interlockable zipper parts, and a slider mounted on said string zipper to cause said first and second zipper parts to separate when said slider is moved in one direction along said string zipper and to cause said first and second zipper parts to interlock when said slider is moved in an opposite direction along said string zipper, wherein said slider comprises:

a plow that pries apart the sections of said first and second zipper parts lying in its path during slider travel in said one direction;

first and second sidewalls disposed on opposite sides of said plow and bounding a slider tunnel, said first zipper part passing through a first space between said first sidewall and said plow, and said second zipper part passing through a second space between said second sidewall and said plow;

a first projection projecting laterally from a distal end of said plow toward said first sidewall; and a second projection projecting laterally from said distal end of said plow toward said second sidewall, wherein said first projection retains a portion of said first zipper part in said first space, said second projection retains a portion of said second zipper part in said second space, and there are no projections projecting from either of said first or second sidewalls that underlie any portion of either of said first or second zipper parts, and wherein said receptacle comprises first and second marginal film portions respectively joined to respective backs of said first and second zipper parts, said slider traveling along said zipper with said first marginal film portion disposed between said first sidewall of said slider and said first zipper part, and said second marginal film portion disposed between said second sidewall of said slider and said second zipper part.

12. The reclosable package as recited in claim 11, wherein said first projection comprises a first ledge that underlies a portion of said first zipper part, said second projection comprises a second ledge that underlies a portion of said second zipper part, and said first ledge is disposed at an elevation higher than an elevation of said second ledge.

13. The reclosable package as recited in claim 11, wherein said first and second projections form opposite sides of a wedge-shaped body disposed at a distal end of said plow.

14. The reclosable package as recited in claim 11, wherein said wedge-shaped body has a tip disposed at an elevation lower than the elevation of a bottom edge of said first sidewall.

15. The package as recited in claim 11, wherein said first marginal film portion is joined only to an upper portion of said back of said first zipper part, thereby displacing upward the area where an internal opening force is exerted on the zipper by product inside said receptacle.

16. The package as recited in claim 15, wherein said second marginal film portion is joined only to an upper portion of said back of said second zipper part.

17. The reclosable package as recited in claim 11, wherein said string zipper further comprises a frangible membrane connecting said first and second zipper parts, said frangible membrane extending inside said receptacle on a product side of said zipper and being joined at its ends to said receptacle for forming an airtight seal.

18. The reclosable package as recited in claim 11, wherein said first zipper part comprises a first closure member having a male profile in the shape of an asymmetric arrowhead.

19. The package as recited in claim 18, wherein said second zipper part comprises a second closure member having a male profile in the shape of an asymmetric arrowhead, said first and second closure members being mutually engaged when said zipper is closed.

20. A reclosable package comprising a receptacle having a mouth, a string zipper joined to said receptacle at said mouth, said string zipper comprising first and second mutually interlockable zipper parts, and a slider mounted on said string zipper to cause said first and second zipper parts to separate when said slider is moved in one direction along said string zipper and to cause said first and second zipper parts to interlock when said slider is moved in an opposite direction along said string zipper, wherein said slider comprises:

a plow that pries apart the sections of said first and second zipper parts lying in its path during slider travel in said one direction;

first and second sidewalls disposed on opposite sides of said plow and bounding a slider tunnel, said first zipper part passing through a first space between said first sidewall and said plow, and said second zipper part passing through a second space between said second sidewall and said plow; and first and second ledges supported by said plow, said first ledge being the only portion of said slider that underlies any portion of said first zipper part, and said second ledge being the only portion of said slider that underlies any portion of said second zipper part, wherein said receptacle comprises first and second marginal film portions respectively joined to respective backs of said first and second zipper parts, said slider traveling along said zipper with said first marginal film portion disposed between said first sidewall of said slider and said first zipper part, and said second marginal film portion disposed between said second sidewall of said slider and said second zipper part.

21. The reclosable package as recited in claim 20, wherein said first ledge has a first elevation and said second ledge has a second elevation different than said first elevation.

22. The reclosable package as recited in claim 20, wherein said first zipper part has a first height and said second zipper part has a second height different than said first height.

* * * * *